US006431090B1

(12) United States Patent
Davis et al.

(10) Patent No.: US 6,431,090 B1
(45) Date of Patent: Aug. 13, 2002

(54) ADJUSTABLE SHELVING WITH TILTABLE SHELVES

(75) Inventors: Ted Davis, Aurora; Bruce Havenga, Downers Grove, both of IL (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/560,938

(22) Filed: Apr. 28, 2000

(51) Int. Cl.[7] ..... A47B 9/00
(52) U.S. Cl. ..... 108/107; 108/147.15; 108/192
(58) Field of Search ..... 108/107, 110, 108/106, 192, 193, 147.12, 147.13, 147.14, 147.15

(56) References Cited

U.S. PATENT DOCUMENTS

| | | | | |
|---|---|---|---|---|
| 4,079,678 A | | 3/1978 | Champagne | |
| 4,230,052 A | | 10/1980 | Champagne | |
| 4,344,368 A | * | 8/1982 | Remington et al. | 108/55.1 X |
| 4,656,952 A | * | 4/1987 | Schweizer | 108/147.13 X |
| 4,715,741 A | | 12/1987 | Kulbersh | |
| 4,754,712 A | | 7/1988 | Olson et al. | |
| 5,127,342 A | * | 7/1992 | Taylor | 108/147.13 |
| 5,531,167 A | * | 7/1996 | Stevens et al. | 108/147.13 X |
| 5,884,567 A | * | 3/1999 | Bartz, Jr. | 108/192 X |
| 6,017,009 A | * | 1/2000 | Swartz et al. | 108/147.13 X |
| 6,036,033 A | * | 3/2000 | Chang | 108/147.13 X |
| 6,044,988 A | * | 4/2000 | Yang | 108/147.13 X |
| 6,079,575 A | * | 6/2000 | Wang | 108/147.13 X |

FOREIGN PATENT DOCUMENTS

| | | | | |
|---|---|---|---|---|
| GB | 835341 | * | 5/1960 | 108/107 |

* cited by examiner

*Primary Examiner*—Jose V. Chen
(74) *Attorney, Agent, or Firm*—Michael Best & Friedrich LLC

(57) ABSTRACT

A shelving system is provided wherein the shelves can be engaged by support members at a plurality of angles relative to the horizontal.

11 Claims, 7 Drawing Sheets

ADJUSTABLE SHELVING WITH TILTABLE SHELVES

FIELD OF THE INVENTION

The present invention relates generally to adjustable shelving. More particularly, the present invention relates to improved shelving that can be adjustably positioned at any of a number of different heights and at a plurality of different angles to the horizontal.

BACKGROUND OF THE INVENTION

Shelving systems comprising shelves that can be installed at a plurality of different heights are well known in the art. Such shelving systems are available from a number of different companies, such as Amco of Chicago, Ill. One such shelving system is described in U.S. Pat. No. 4,754,712, issued to Olson et al. ("Olson '712").

In general and as described in Olson '712, the teachings of which are incorporated by reference herein, these systems feature a rack of adjustable shelves having a simple and economical shelf support mechanism. In one embodiment of the shelving system described in Olson '712, for example, a shelf is attached to four supporting vertical posts by placing each of the posts through an individually associated corner socket of the shelf. A tapered "keeper" fits between the shelf socket and the post to keep the shelf in position on the post. Each post has a plurality of notches positioned along the length of the post and each keeper has at least one internal detent or projection to fit into any one of the notches. Thus, the keeper can be installed at a variety of heights along the post, thereby allowing a shelf to be positioned and held at any of a number of desired heights on the post.

Although Olson '712 provides a simple and economical mechanism for supporting a shelf in a substantially horizontal position at a number of different heights, it does not provide a mechanism for supporting the shelf at a number of different angles to the horizontal, i.e., a mechanism for allowing one to easily adjust the "tilt" of the shelf Thus, because it is often desirable to tilt a shelf to better showcase an item stored thereon or to make items stored toward the rear of the shelf more accessible, there exists a need for a shelving system having tiltable shelves that can be adjustably positioned at one of a plurality of angles and at any of a number of desired heights on the shelf support system.

Accordingly, an object of the present invention is to provide a simple and sturdy rack of adjustable shelves in which the shelves can be quickly and easily positioned at different selected heights on a support system and also be adjustably tilted with respect to the horizontal.

SUMMARY OF THE INVENTION

In general, the present invention fulfills the foregoing needs by providing a shelving system that can be engaged by support members at a plurality of angles relative to the horizontal. In a preferred embodiment, the shelving system comprises at least one shelf with at least one protrusion near the front of the shelf and at least another protrusion near the rear of the shelf. A plurality of vertical posts support the shelf Support. members are mounted on each post at any one of a plurality of locations along the posts.

In this embodiment, each support member has a surface adapted to receive the protrusions at a plurality of angles to the horizontal in order to accommodate the tilt of the shelf The front and rear support members for any particular shelf may be mounted on the posts at the same height so that the shelf is level with the horizontal or the rear support members may be mounted at a different height from the front support members to tilt the shelf to a desired angle to the horizontal.

In an alternate embodiment, each support member comprises a protrusion and the shelf is adapted to receive such protrusions at a variety of angles. If the rear support members are located on the support posts at a height above or below the front support members, the shelf will then be tilted upwardly from front to back or vice versa.

DETAILED DESCRIPTION OF THE PREFERRED EMBODIMENTS

Figure 1:
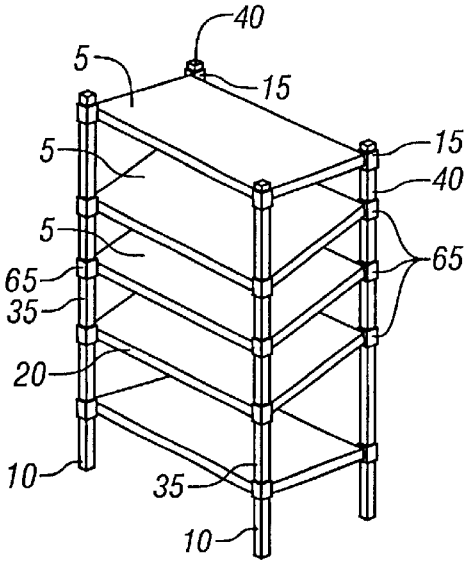
FIG. 1 is a perspective view of an embodiment of the inventive shelving system.

As shown in FIGS. 1–5, a preferred embodiment of the present invention comprises at least one shelf 5 supported by a front support 10 and a rear support 15. As shown in FIG. 1, front supports 10 comprises two front vertical posts 35 and back support 15 comprises two rear vertical posts 40. Each of the vertical posts adjustably supports a corner of shelf 5.

In the embodiment shown in FIGS. 1–5, shelf 5 is rectangular in shape and comprises two channels 20, 25 which extend on opposite sides (i.e., the front and back sides of the shelf along the length of the shelf). The shelf surface is formed by a plurality of parallel, spaced-apart wire rods 23 that run lengthwise between channels 20, 25. The rods 23 are supported by cross rods 27, all of the components being made of stainless steel in the preferred embodiment. Thus, the shelf 5 is formed by cross rods 27 which are welded to channels 20, 25 to form a framework to support the rods 23.

At each end of shelf 5 a mounting rod 55 extends across the width of the shelf and is secured, for example, by welding, to the ends of channels 20, 25. The ends of wire rods 23 extend over the mounting rods 55 and are also welded to the mounting rods. Each end of the mounting rods 55 extends beyond channels 20, 25 about ½", thereby forming protrusions for engagement with support members 60 as explained hereinafter.

In the embodiment shown in FIGS. 1–5, shelf 5 is pivotally mounted to front posts 35 and rear posts 40 by means of support members 60. Support member 60 is adapted to receive one end of the protruding mounting rods 55 such that the shelf can be pivoted relative to the associated support post.

Figure 2:
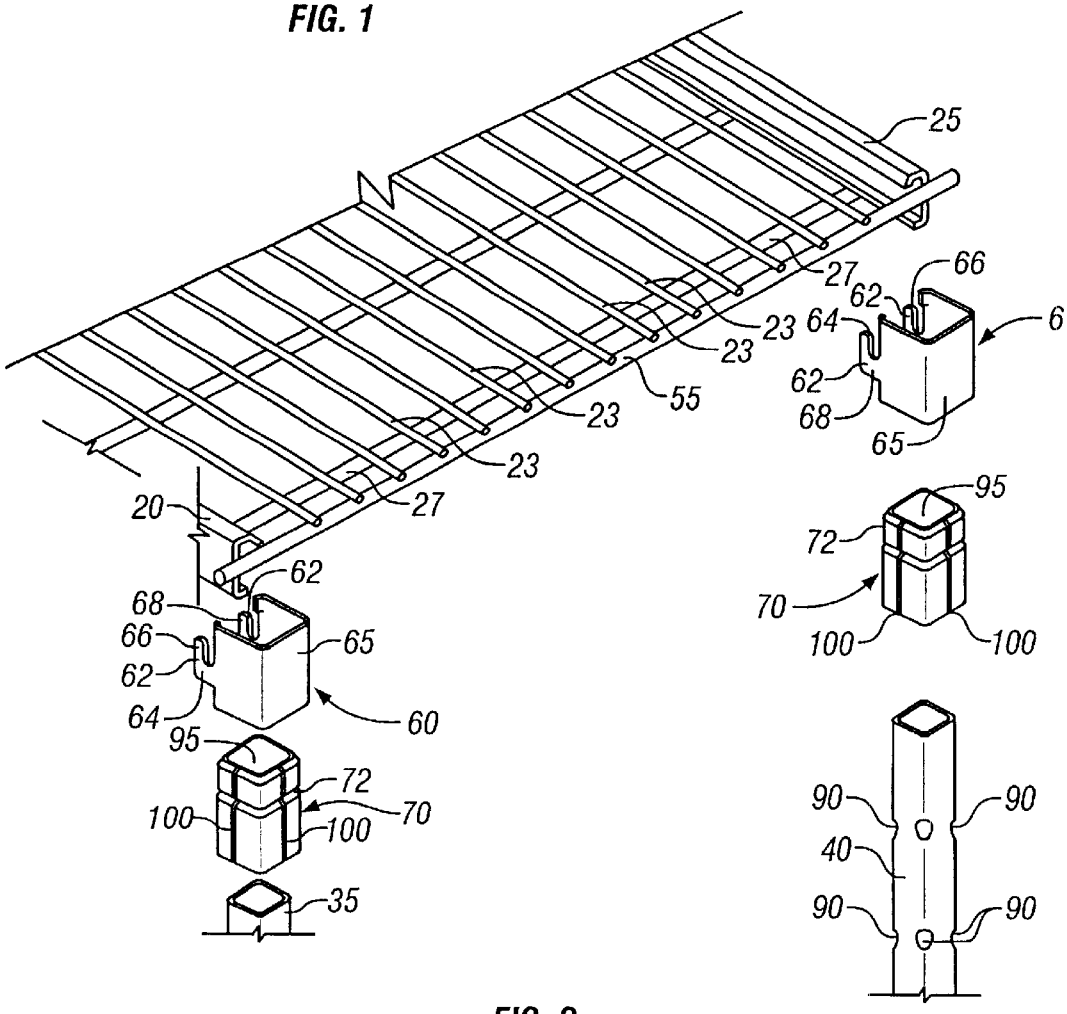
FIG. 2 is a partially exploded view of a portion of the shelving system of FIG. 1.
Figure 3:
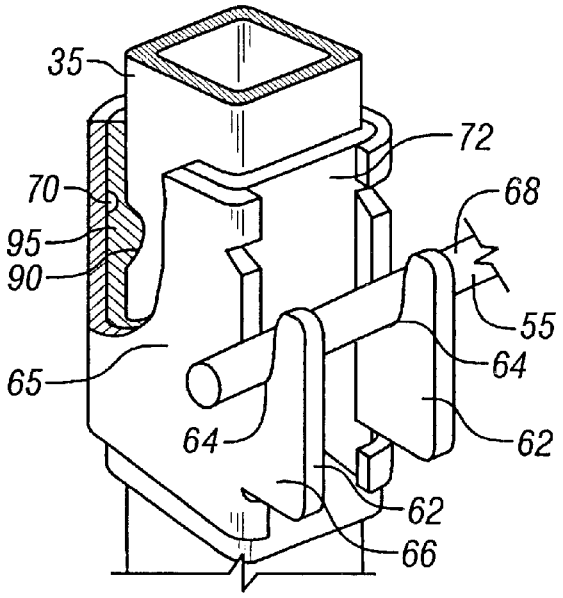
FIG. 3 is perspective view in partial cross-section of the end of a mounting rod mounted within a support member of the inventive shelving system.
Figure 6:
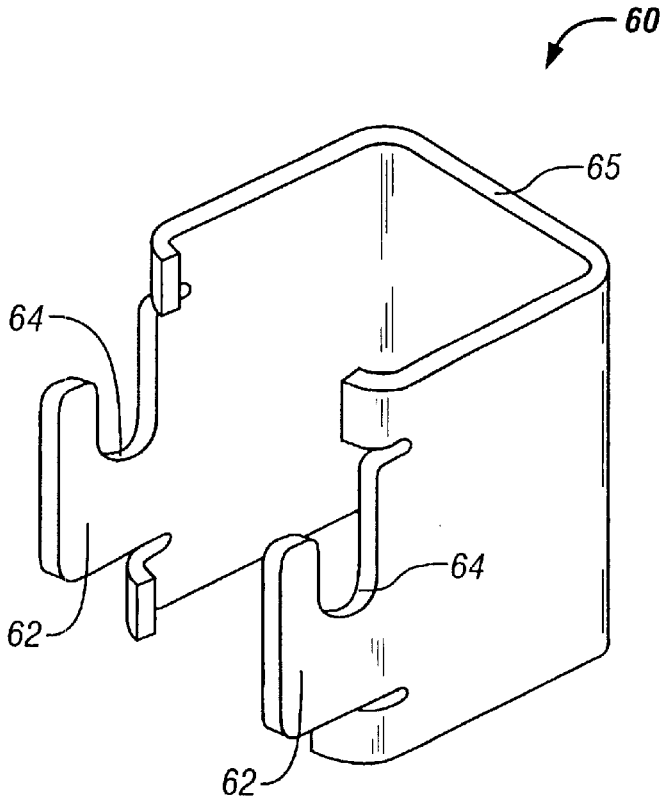
FIG. 6 is a perspective view of an embodiment of a support member of the inventive shelving system.
Figure 7:
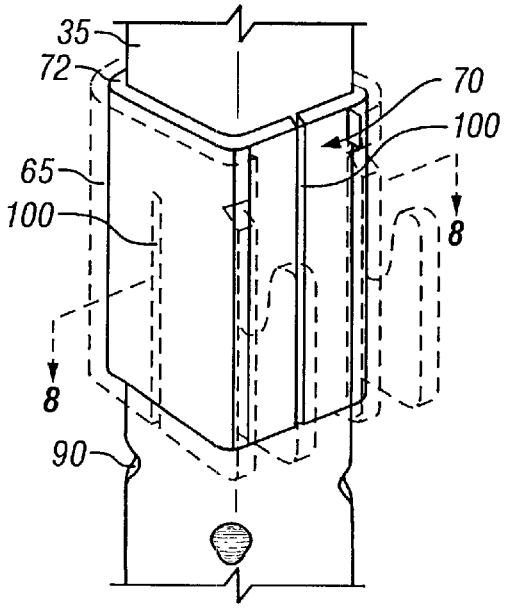
FIG. 7 is perspective view of an embodiment of a keeper mounted on a support post, with phantom lines showing the position of a support member on the keeper, of the inventive shelving system.

The details of a preferred support member 60 are shown in FIGS. 2, 3 and 6. As there shown, each support member 60 comprises a U-shaped sleeve 65 mounted around the support posts 35, 40. Sleeve 65 comprises one or more side arms 62—preferably two—each defining a notch 64 adapted to receive the end of a mounting rod 55. As shown in FIGS. 2–3, each sleeve 65 fits around an associated post so that the side arms 62 extend inwardly towards the shelves from the support post and parallel to the length of the shelf. When so positioned, each sleeve 65 has an outer arm 66 and an inner arm 68.

Figure 4:
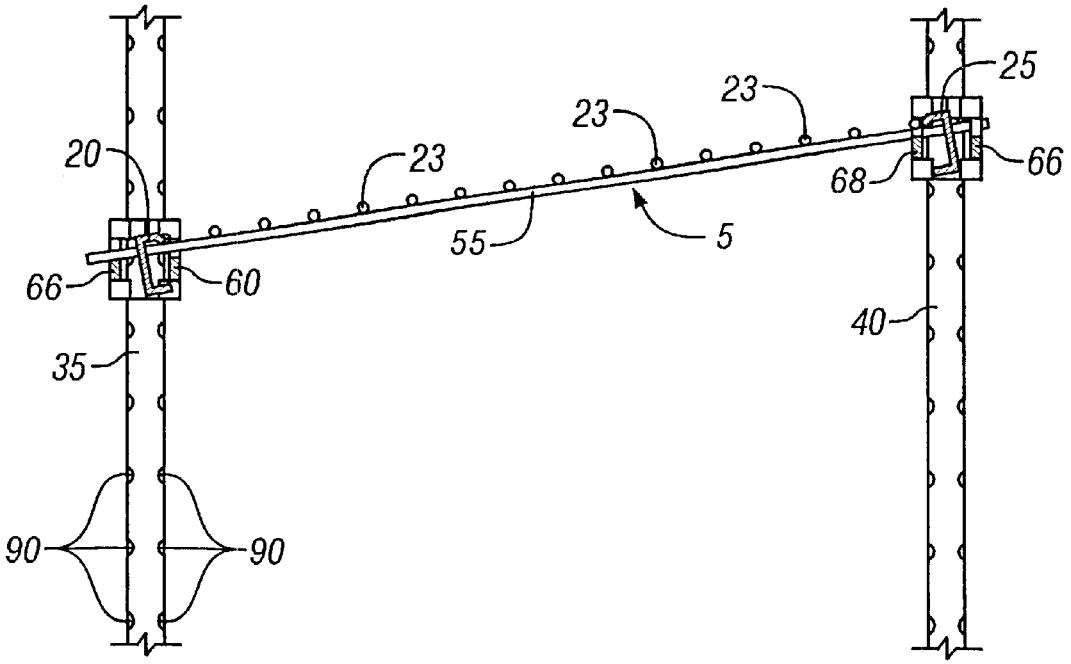
FIG. 4 is side elevational view in partial cross-section of a shelf mounted at a slight incline on an embodiment of the inventive shelving system.
Figure 5:
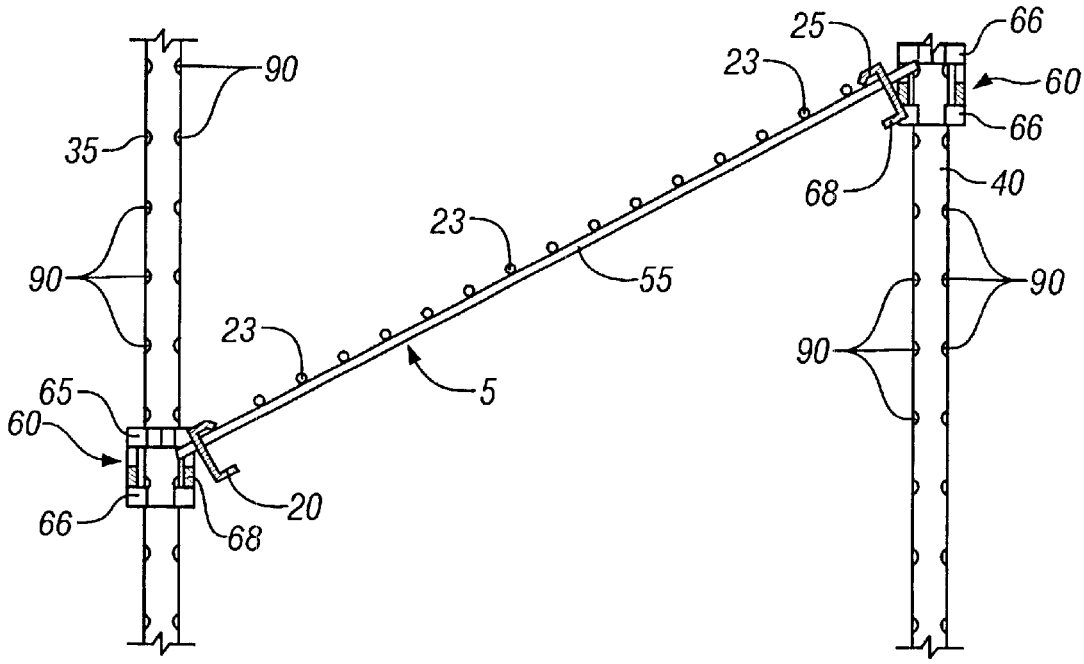
FIG. 5 is side elevational view in partial cross-section of a shelf mounted at a slight incline on an embodiment of the inventive shelving system.

As shown in FIGS. 1, 4 and 5, sleeves 65 can be mounted at a plurality of different heights along the support posts 35, 40. Each sleeve 65 is mounted to a post by means of a keeper 70 that fits around the post. Keeper 70 forms a wedge between the post and the sleeve 65 when in position on the post. In the embodiment shown in FIGS. 2–3 and 7–10, keeper 70 comprises a truncated, generally pyramid-shaped sleeve 72 which can be placed around and mounted on the support posts 35, 40. The interior of sleeve 65 also has a truncated pyramid-like shape that corresponds to that of keeper 70. In the preferred embodiment, keeper 70 can be mounted at a plurality of positions along the length of a support. post. As best seen in FIGS. 2–5, one or more recesses 90 are located at regular intervals along the length of the posts to receive and accommodate detents 95 located on the interior of keeper 70 in order to lock keeper 70 in a selected position on a post.

In one embodiment, keeper 70 has vertical slots 100 in each side wall 105 and is made from a suitably flexible material, such as nylon. The flexible nature of the keeper 70 and the vertical slots 100 therein allow side walls 105 to be spread apart and slipped around a support post. When slipped around a support post, detents 95 lock into recesses 90 to secure the keeper 70 onto the post. When the detents 95 are disengaged from the recesses 90, the keeper can be repositioned to move up or down the support post. The flexible nature of the keeper 70 and the vertical slots 100 therein also allow the cross-section of the interior of keeper 70 to be slightly smaller than that of the post so that the keeper 70 will lock around the post. When a keeper 70 is placed around a support post at a selected height with detents 95 locked in recesses 90, a sleeve 65 is placed over the keeper 70 and wedged downward on the keeper. The sleeve 65, preferably made from a more rigid material than the keeper 70, such as stainless steel, thereby squeezes the resilient sides of the keeper 70 together around the support post to more securely lock or wedge detent 95 into recess 90.

Thus, to mount a shelf 5 on the support posts, keepers 70 are first slipped around the posts at selected heights—with the two front keepers at one height and the two rear keepers at the same or a different height. Of course, all four keepers may be placed at the same height so that the shelf is level with the horizontal. The detents 95 located in the interior of the keepers are locked into the selected recesses 90 on the support posts. The sleeves 65 are then securely wedged over the keepers 70 to tightly squeeze. the keepers around the posts and more securely lock the detents 95 into the recesses 90. When all four keepers 70 and sleeves 65 are mounted on the support posts at the same height so that the shelf 5 is level with the horizontal, the ends of the mounting rods 55 rest in the side arm notches 64 on both the inner 68 and outer 66 arms on sleeves 65 (see FIGS. 2–3). Weight added to the shelf 5 presses the shelf downwardly in notches 64, further wedging the sleeves 65 more tightly down over the keepers 70.

As shown in FIGS. 4–5, if the rear keepers are located on the support posts at a height above (or below the front keepers), the shelf will then be tilted upwardly from front to back (or vice versa). Typically, a shelf will be tilted so that the rear of the shelf is higher than the front of the shelf However, which side of the shelf is referred to as the front or rear is of no consequence.

When the shelf is horizontal (see FIGS. 2–3) or only slightly tilted (see FIG. 4), the ends of the mounting rods 55 rest in the side arm notches 64 on both the inner 68 and outer 66 arms on sleeves 65. When the shelf is tilted so that one side is significantly higher than the other, the mounting rods 55 will only rest in the side arm notch 64 of the inner arm 68 on each sleeve 65 (FIG. 5).

For example, if the rear keepers 70 and sleeves 65 are positioned on the two rear support posts 40 slightly above the position of the front keepers 70 and sleeves 65 on the two front support posts 35 as shown in FIG. 4, the shelf 5 will tilt at a slight angle upward from front to back. In this position, the ends of the mounting rods 55 rest in the side arm notches 64 on both the inner 68 and outer 66 arms on sleeves 65 and the rear channel 25 is disposed between the inner 68. and outer 66 side arms on the rear sleeves 65. The rear channel 25 will prevent the shelf from sliding forward out of the rear sleeves 65 by acting as a stop against the inner side arm 68 on the rear sleeves 65. The shelf 5 is thus securely held in place against sliding off the rear sleeves 65 under the force of gravity when the shelf is tilted upwardly from front to rear.

On the other hand, if the rear keepers 70 and sleeves 65 are positioned on the two rear support posts 40 significantly above the position of the front keepers 70 and sleeves 65 on the two front support posts 35 as shown in FIG. 5, the shelf 5 will tilt at a significant angle upward from front to back. When the rear and front keepers and sleeves are so positioned so that the shelf is significantly tilted, the distance between the rear and front keepers and sleeves is increased in comparison to when the shelf is level with the horizontal or only slightly tilted. As a result and because of the angle of tilt, the ends of supporting rods 55 may only rest in the notches 64 of the inner side arms 68.

In this position, the front and rear channels 20, 25 will be disposed outside the space between the inner and outer side arms 68, 66, with the channels resting adjacent the outer surfaces of the inner side arms 68. The front channel 20 abuts the inner side arm 68 of the front support members 66 to prevent the shelf from sliding forward.

Figure 9:
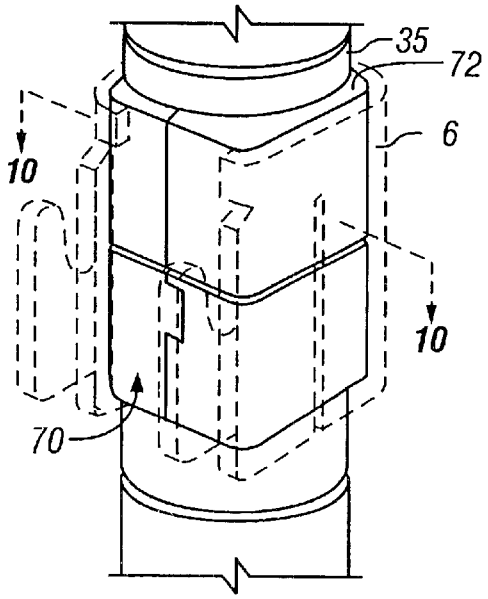
FIG. 9 is perspective view of another embodiment of a keeper mounted on a support post, with phantom lines showing the position of a support member on the keeper, of the inventive shelving system.
Figure 8:
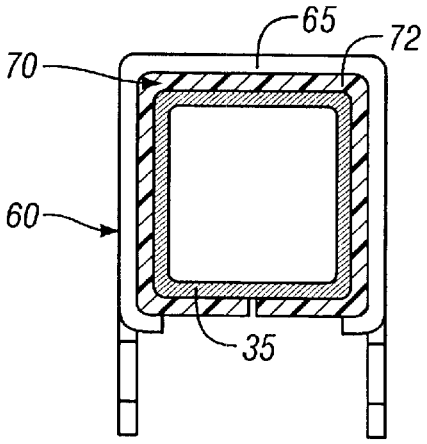
FIG. 8 is a cross-sectional top plan view of the assembly of FIG. 7 taken along line 7—7.
Figure 10:
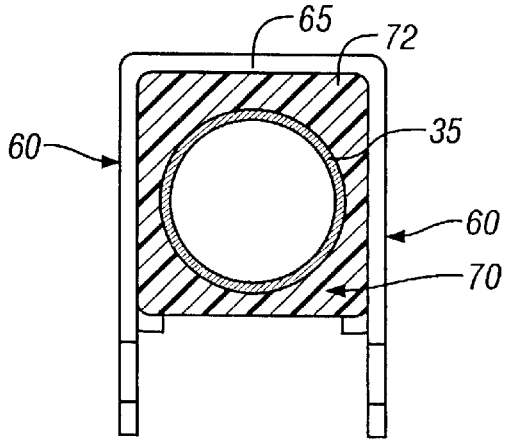
FIG. 10 is a cross-sectional top plan view of the assembly of FIG. 9 taken along line 9—9.
Figure 11:
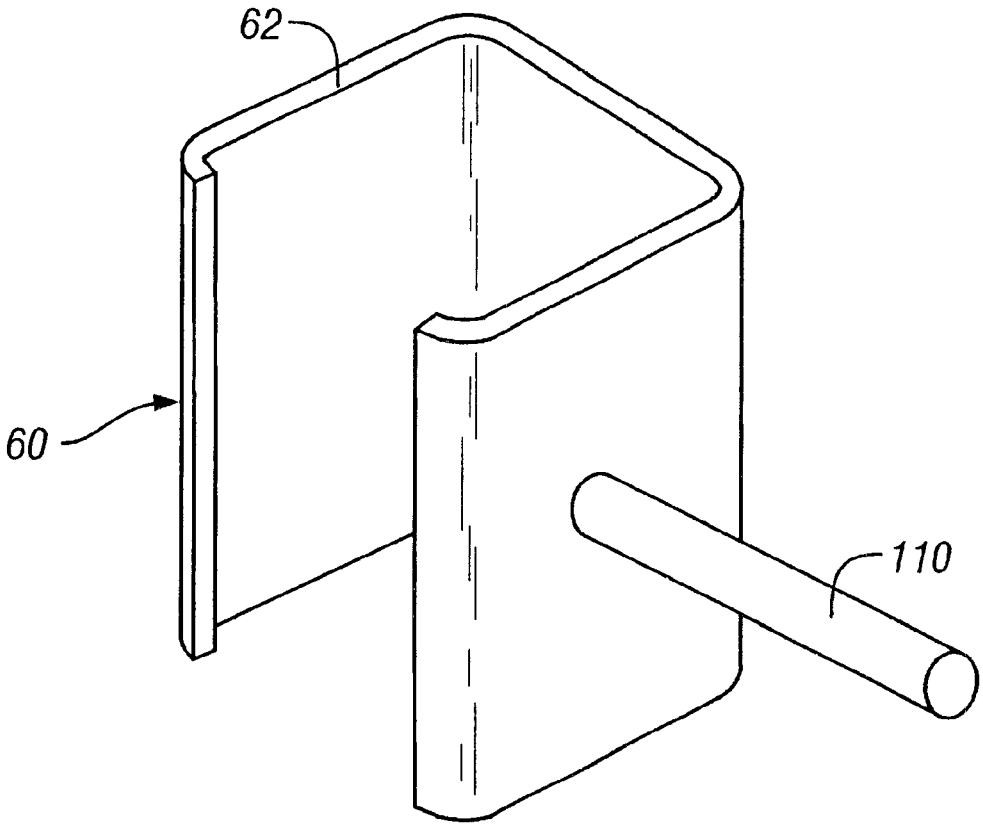
FIG. 11 is a perspective view of another embodiment of a support member of the inventive shelving system.
Figure 12:
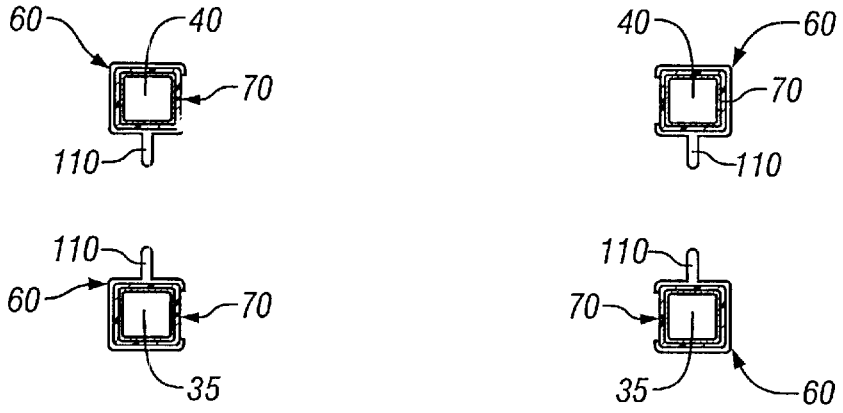
FIG. 12 is a top plan view showing the orientation of the mounting member of FIG. 11 as mounted on support posts of the inventive shelving system.
Figure 13:
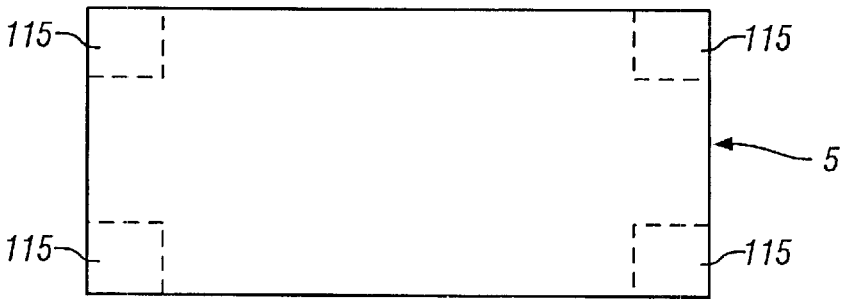
FIG. 13 is a top plan view of an embodiment of a shelf for use with the mounting member of FIG. 11, with phantom lines showing the positions of the receiving spaces in the shelf, of the inventive shelving system.
Figure 14:
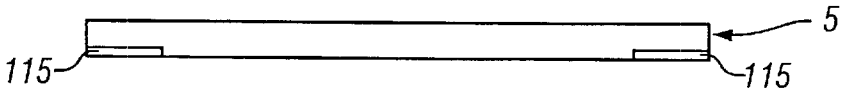
FIG. 14 is a rear elevational view of the shelf of FIG. 13.
Figure 15:
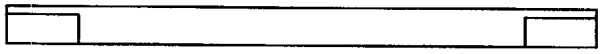
FIG. 15 is a front elevational view of the shelf of FIG. 13.
Figure 16:
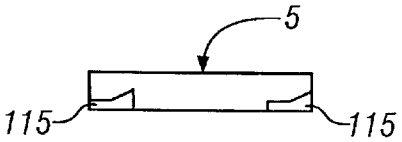
FIG. 16 is a left side elevational view of the shelf of FIG. 13.
Figure 17:
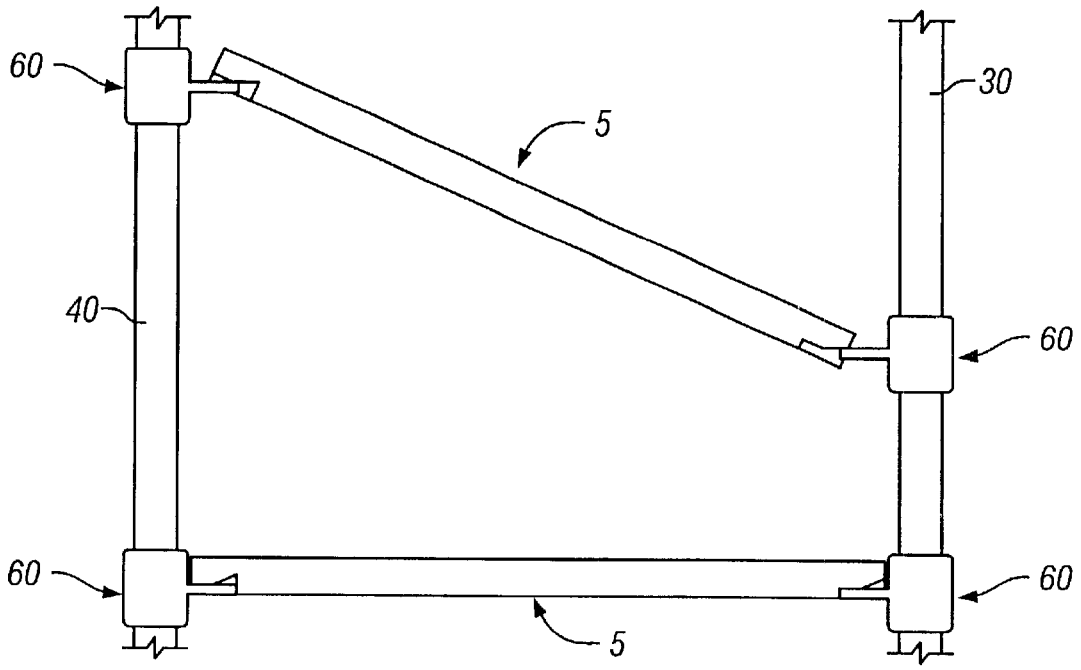
FIG. 17 is a side elevational view of a portion of an embodiment of the inventive shelving system featuring the mounting member of FIG. 11 and the shelf of FIG. 13.

Because the posts illustrated in FIGS. 1–5 and 7–8 have rectangular cross-sections, the cross-sections of sleeve 65 and keeper 70 are also generally rectangular. However, those skilled in the art will readily understand how to adapt sleeve 65 and keeper 70 for use with other shaped support posts, such as circular posts. For example, as illustrated in FIGS. 9–10, if a support system comprises posts having circular cross-sections, then the interior of keeper 70 would also have a generally circular cross-section.

In another embodiment, the shelf 5 is pivotally engaged by the support members 60 by means of protrusions on the support members. As shown in FIGS. 11–17, each support member 60 of this particular embodiment comprises a protrusion in the form of a mounting arm 110, with each support member 60 oriented on its corresponding support post 40 such that mounting arms 110 point toward shelf 5 and are substantially parallel to the sides of shelf 5.

In this embodiment, shelf 5 defines a receiving space 115, such as a cavity or an aperture, to correspond with and receive each support member 60. The mounting arm 110 of each support member 60 fits within the corresponding shelf receiving space 115 to pivotally engage the shelf 5. Thus, the shelf 5 can thereby be supported at a number of different angles by positioning the front and back support members 60 at different heights in the manner discussed above.

While the present invention is described above in connection with specific embodiments, the invention is intended to cover all alternatives, modifications or equivalents that may be. included within its sphere and scope, as defined by the appended claims.

What we claim is:

1. A shelf system comprising:

at least one shelf, the shelf having a front and a back;

a front protrusion extending from a position near the front of the shelf;

a back protrusion extending from a position near the back of the shelf;

a front support adapted to support the front of the shelf;

a back support adapted to support the back of the shelf;

a front shelf support member adapted to be adjustably mounted at any one of a plurality of locations on the front support, the front shelf support member having a projection extending in a direction along the front of the shelf, the projection defining a space corresponding to and adapted to receive the front protrusion at a plurality of angles relative to the horizontal; and a back shelf support member adapted to be adjustably mounted at any one of a plurality of locations on the back support, the back shelf support member having a projection extending in a direction along the back of the shelf, the projection defining a space corresponding to and adapted to receive the back protrusion at a plurality of angles relative to the horizontal.

2. The shelf system of claim 1 wherein the front and back protrusions comprise a rod with a first and second end, said rod extending between the front and back of the shelf, the first end of the rod defining the front protrusion and the second end of the rod defining the back protrusion.

3. The shelf system of claim 2 comprising a rod extending between the front and back of the shelf at opposite ends of the shelf.

4. The shelf system of claim 1 wherein the front and back supports each comprises a vertical post.

5. The shelf system of claim 4 wherein each shelf support member comprises a sleeve that fits around the vertical posts.

6. The shelf system of claim 5 wherein the projection comprises at least one arm defining the space adapted to receive the corresponding protrusion.

7. The shelf system of claim 6 wherein the arm defines a notch for receiving and supporting the corresponding protrusion.

8. The shelf system of claim 6 wherein the projection comprises two spaced-apart arms, each arm defining a notch for receiving and supporting the corresponding protrusion.

9. The shelf system of claim 5 comprising a tapered keeper to fit around said vertical posts and wherein said sleeve is adapted to fit around and squeeze the keeper in a wedging relationship when the sleeve is mounted around the keeper on the vertical posts.

10. A shelf system comprising:

at least one shelf, the shelf having a front and back;

a front support adapted to support the front of the shelf;

a back support adapted to support the back of the shelf;

a front protrusion extending from a position near the front of the shelf;

a back protrusion extending from a position near the back of the shelf;

a front shelf support member adapted to be mounted at any one of a plurality of locations on the front support, the front shelf support member having at least one arm extending in a direction along the front of the shelf and defining a notch adapted to receive the front protrusion at a plurality of angles relative to the horizontal; and a back shelf support member adapted to be adjustably mounted at any one of a plurality of locations on the back support, the back shelf support member having at least one arm extending in a direction along the back of the shelf and defining a notch adapted to receive the back protrusion at a plurality of angles relative to the horizontal.

11. The shelf system of claim 10 wherein each of the front and back shelf support members comprises a pair of spaced-apart arms extending in a direction along the front and back of the shelf, each arm on the shelf support members defining a notch for receiving and supporting the corresponding protrusion.

* * * * *